US006266951B1

(12) United States Patent
Chakravarti

(10) Patent No.: US 6,266,951 B1
(45) Date of Patent: Jul. 31, 2001

(54) CUT RESISTANT YARN AND APPAREL

(75) Inventor: Kalidas Chakravarti, Vermilion, OH (US)

(73) Assignee: Whizard Protective Wear Corp., Birmingham, OH (US)

( * ) Notice: Subject to any disclaimer, the term of this patent is extended or adjusted under 35 U.S.C. 154(b) by 0 days.

(21) Appl. No.: 09/225,295

(22) Filed: Jan. 8, 1999

Related U.S. Application Data

(60) Provisional application No. 60/070,892, filed on Jan. 9, 1998.

(51) Int. Cl.[7] ..... D02G 3/02

(52) U.S. Cl. ..... 57/210; 57/230

(58) Field of Search ..... 57/210, 230; 5/2.5, 5/167; 442/203; 428/222; 424/404, 409

(56) References Cited

U.S. PATENT DOCUMENTS

| | | | | |
|---|---|---|---|---|
| 2,942,442 | | 6/1960 | Michael-Lohn . | |
| 3,739,400 | | 6/1973 | Colehower . | |
| 4,128,529 | | 12/1978 | Becker et al. . | |
| 4,470,251 | | 9/1984 | Bettcher . | |
| 4,528,223 | | 7/1985 | Kumazawa . | |
| 4,651,514 | | 3/1987 | Collot . | |
| 4,777,789 | | 10/1988 | Kolmes et al. . | |
| 4,838,017 | * | 6/1989 | Kolmes et al. | 57/210 |
| 4,842,932 | | 6/1989 | Burton . | |
| 4,864,852 | | 9/1989 | Booone . | |
| 4,912,781 | | 4/1990 | Robins et al. . | |
| 4,936,085 | | 6/1990 | Kolmes et al. . | |
| 5,070,540 | | 12/1991 | Bettcher et al. . | |
| 5,119,512 | | 6/1992 | Dunbar et al. . | |
| 5,135,811 | | 8/1992 | White et al. . | |
| 5,177,948 | | 1/1993 | Kolmes et al. . | |
| 5,321,960 | | 6/1994 | Whit et al. . | |
| 5,568,657 | | 10/1996 | Cordova et al. . | |
| 5,597,649 | | 1/1997 | Sandor et al. . | |
| 5,628,172 | | 5/1997 | Kolmes et al. . | |
| 5,674,513 | * | 10/1997 | Snyder, Jr. et al. | 424/404 |
| 5,686,096 | | 11/1997 | Khan et al. . | |
| 5,721,179 | | 2/1998 | Shi et al. . | |
| 5,822,791 | * | 10/1998 | Baris | 2/2.5 |
| 5,845,476 | | 12/1998 | Kolmes . | |
| 5,856,005 | * | 1/1999 | Gurian | 428/370 |
| 5,919,554 | | 7/1999 | Watterson, III et al. . | |
| 5,965,223 | | 10/1999 | Andrews et al. . | |

FOREIGN PATENT DOCUMENTS

| | | |
|---|---|---|
| 53-45443 | 4/1978 | (JP) . |
| 60-209038 | 10/1985 | (JP) . |
| 9935315 | 7/1999 | (WO) . |

OTHER PUBLICATIONS

Microban ® Custom Designed Applications For the Food Service Industry, Microban Products Company, 1994 p. 4, column 1, third paragraph.*

* cited by examiner

*Primary Examiner*—John J. Calvert
*Assistant Examiner*—Gary L. Welch
(74) *Attorney, Agent, or Firm*—Watts, Hoffman, Fisher & Heinke Co.

(57) ABSTRACT

A knittable, cut-resistant yarn for use in protective wear, such as gloves, arm protectors, aprons, or the like, including a core with at least one strand of flexible, stainless steel wire having a diameter of about 0.002 inches and at least one strand of an anti-microbial treated fiber. A first wrap is wound in one direction about the core and is a polyester fiber having a denier in the range of 40–600 and a second wrap is wound in a second direction about the core which includes at least one strand of a polyester fiber having a denier in the range of 40–600. The anti-microbial treated fiber may be acetate-based, acryl-based or olefinic. The anti-microbial treated fiber contains an anti-microbial agent, such as Microban-B, where the active ingredient is 5 chlor-2-(2,4 dichlorophenoxy) phenol.

17 Claims, 1 Drawing Sheet

CUT RESISTANT YARN AND APPAREL

This Appln. claims benefit of Prov. No. 60/070,892 filed Jan. 9, 1998.

TECHNICAL FIELD

This invention relates to a cut-resistant yarn and apparel made therefrom, specifically a protective glove.

DISCLOSURE OF THE INVENTION

The present invention provides a new and improved yarn that provides both cut-resistance and protection bacteria that can reside in gloves, especially when used in various industries, and result in an unsanitary condition, or improper washing after using the gloves.

A preferred yarn is suitable in diameter for machine knitting and is flexible enough to be used for making protective gloves. Preferably the yarn is of composite construction utilizing synthetic fibers and metallic wire. At least one of the fibers contains an anti-microbial chemical.

In its broad aspects, the yarn is comprised of a fiber strand that contains an anti-microbial chemical and a stand of cut-resistant material and is of a total denier and diameter suitable to be knit on a commercial knitting machine.

In a more preferred embodiment, the knittable cut-resistant yarn comprises a core having at least one strand of flexible, stainless steel having a diameter in the range of 0.001–0.004 inch and preferably a diameter of substantially 0.002 inches and at least one strand of the fiber that contains the anti-microbial chemical. A first wrap is wound in one direction about the core and, in the preferred embodiment, comprises polyester fiber having a denier in the range of 150–400. In the illustrated embodiment, the first wrap has a denier of substantially 240. A second wrap is wound in a second direction about the core and preferably includes at least one strand of a polyester fiber also having a denier in the range of 40–400. In the illustrated embodiment the fiber of the second wrap also has a denier of substantially 240.

Both the first and second wraps are preferably wound about the core at a rate of 7–12 turns per inch. In the illustrated embodiment the first and second wraps are wrapped at the rate of 8 turns per inch.

In the preferred embodiment, the anti-microbial treated fiber is a acetate-based fiber containing the active ingredient 5 chlor-2-(2,4 dichlorophenoxy) phenol or equivalent. A chemical of this type is sold under the brand name Microban-B which is available from Microban Products Company of Huntersville, N.C. An acetate-based fiber containing an anti-microbial chemical is available from Hoechst Celanese and is sold under the brand name Microsafe.

Other anti-microbial treated fibers may be used and are contemplated by this invention. For example, an anti-microbial treated, acrylic-based fiber may be used. This type of fiber is available from Sterling Fibers, Inc. and is sold under the designation CTF ANTIMICROBIAL acrylic fiber. Polypropylene or olefinic fibers impregnated with anti-microbial agents are also available and are also contemplated by the present invention. It is believed that an anti-microbial olefinic fiber is available from Filament Fiber Technology, Incorporated. In the preferred embodiment of the invention, the anti-microbial treated fiber has the anti-microbial agent as an integral part of the fiber, as opposed to being a topical agent. In the preferred embodiment, the anti-microbial agent forms part of the matrix of the polymer.

In the illustrated embodiment the core also includes at least one strand of a high strength, cut-resistant polyester fiber having a denier in the range of 150–1000 and, in the illustrated embodiment, preferably has a denier of about 420.

The yarn described above can be used to make protective gloves of the type that are used in the food handling industry. It has been found that the gloves made according to the invention are capable of dealing with bacteria that comes in contact with the glove. In the preferred construction the anti-microbial treated fiber is located in the core, which is positioned substantially centrally with respect to the overall yarn.

It is believed that by locating the anti-microbial treated fiber within the core, enhanced performance is provided. If the yarn, for example, is used to make a glove used in the food handling and processing industry, bacteria is transmitted to the glove when the outside of the glove makes contact with fluids and solutions encountered in processing or handling food, such as meat. As a result of capillary action, these fluids migrate towards the center of the yarn. The bacteria is carried to the center of the yarn with fluid. Once the bacteria makes contact with the anti-microbial treated fiber, its growth and propagation is inhibited. Based on experimentation conducted by the inventor, it is believed that forming the wrap from an anti-microbial treated fiber would still have some effectiveness in inhibiting the growth of the bacteria. However, the effectiveness is increased by using the anti-microbial fiber in the yarn core. With the preferred construction, wash the glove with appropriate detergent and water will remove all bacterial contamination from the surface of the glove, and the core of the glove will also be free of bacteria due to the presence of the anti-microbial agent.

Additionally, ac d anti-microbial fibers may be fragile. By locating this particular acetate, anti-microbial fiber in the core, protection is afforded to the fiber, thus reducing the chance of breakage or failure.

Additional features of the invention will become apparent and a fuller understanding obtained by reading the following detailed description made in connection with the accompanying drawings

BEST MODE FOR CARRYING OUT THE INVENTION

Figure 1:
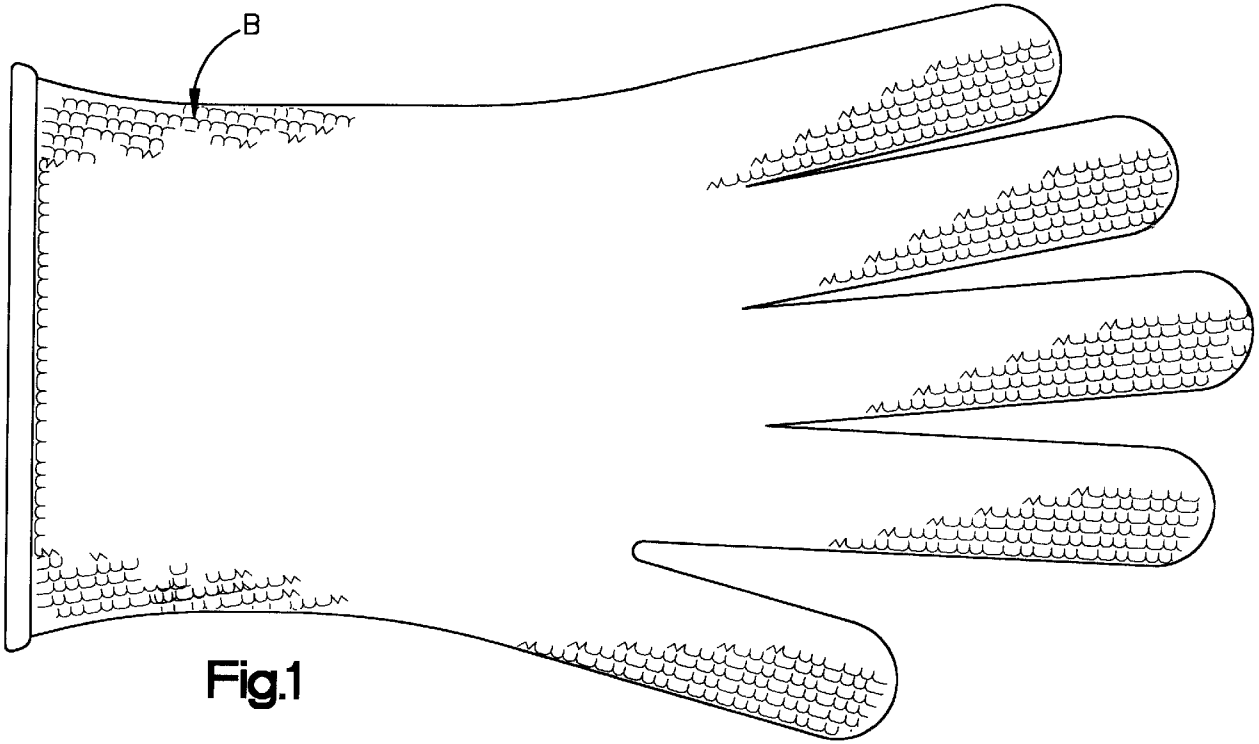
FIG. 1 is a diagrammatic plan view of a protective glove, embodying the present invention; and, FIG. 2 is a diagrammatic drawing of a composite yarn constructed in accordance with the invention.
Figure 2:
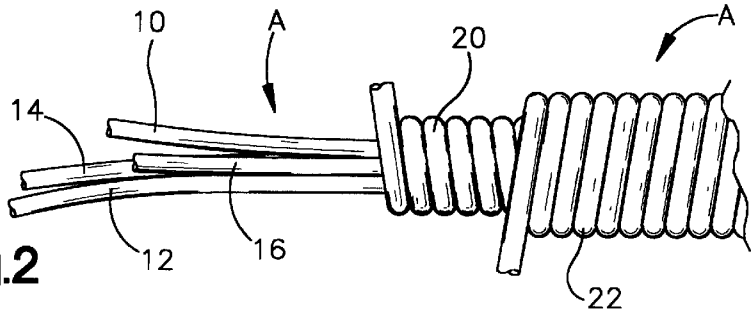

A preferred embodiment of the yarn A of this invention is shown in FIG. 2 of the appended drawings and is suitable for machine knitting a protective glove B shown in FIG. 1. The yarn A has a central core 10 comprised of two 150 denier fiber strands 12, 14 combined to provide 300 deniers of acetate fiber that contain Microban-B anti-microbial chemical, a wire strand 16 of 0.002 inch diameter annealed stainless steel and a strand 18 of 420 denier Hoechst Celane polyester, which is cut-resistant and shrink-resistant. The core strands are substantially parallel. The yarn has two covering wrappings 20, 22, each wound in an opposite direction from the other, eight turns per inch with each turn substantially touching the next to substantially cover the core.

It has been found that when the anti-microbial treated fiber comprises 15% to 30% of the overall composition of the yarn, adequate results are obtained. It should be understood, however, that the anti-microbial treated fiber may comprise a larger percentage of the yarn, but is believed that the added cost does not produce a commensurate increase in effectiveness. In addition, in the preferred embodiment, the anti-microbial treated agent forms an integral part of the fiber, rather than being a topically applied agent. In the preferred fiber, the agent forms part of the matrix of the polymer.

In the illustrated embodiment, each wrapping is a strand of 240 denier solution dyed polyester and provides an overall coloring to the glove. It has been found that the use of 240 denier dyed polyester gives a pleasing color to the glove when overall coloring is desired. It is believed that the use of alternate denier polyester fiber may be used (if overall coloring is not a concern) without substantially affecting the performance of the glove. The denier of the wrapping fiber may vary between 70 and 840. Nylon may be substituted for polyester fiber used in the wraps 20, 22. The denier range for nylon is 40–840.

Acetate fiber was used because of the availability of anti-microbial chemicals incorporated into polymeric fiber, in industrial quantities. While Microban-B, made by Microban Products Co. of Huntersville, N.C., USA is used in the preferred embodiment, other sources or other products containing the active ingredient 5 chlor-2-(2,4 dichlorophenoxy) phenol can be used. The acetate fiber is marketed by Hoechst Celanese Corporation under the trademark Microsafe. In the preferred embodiment, the acetate strands 12, 14 constitute 25% by weight of the total yarn. It is believed that generic anti-microbial agents may also be used.

Non acetate-based fibers are also available and are contemplated by the present invention. For example, Sterling Fibers, Inc. markets an acrylic-based, anti-microbial fiber that is suitable for use in the disclosed yarn construction. This fiber is marketed under the designation CTF ANTIMICROBIAL acrylic fiber. An anti-microbial polyethylene or olefinic fiber is also available. It is believed that such a fiber is marketed by Filament Fiber Technology, Incorporated.

Although the preferred embodiment has been described, it will be understood that modifications can be made within the scope of the invention. For example, the two core strands 12, 14 (that contain the anti-microbial agent) can each vary in denier from 55 to 300, the strand 16 can vary is diameter from 0.0016 to 0.003 inch in diameter, and the core strand 18 can vary in denier from 200 to 1000 while still providing a flexible machine knittable cut-resistant yarn particularly suitable for a protective glove. The strands 12, 14 can be replaced with a single strand of an anti-microbial fiber of suitable denier. For other uses, even lesser or greater deniers and diameters can be used, for example in lighter weight less cut-resistant gloves or in heavier protective garments. If greater cut-resistance is desired, a fiber of greater cut-resistance than Hoechst Celanese polyester can be used for strand 18, e.g., long chain polyethylene or para aramid or liquid crystal polyester, or glass fibers, or polybenzo-bisoxazole polymeric fibers. It is contemplated that the strand or strands containing anti-microbial chemical may constitute between 8 and 40% by weight of the yarn.

I claim:

1. A knittable cut-resistant yarn for use in protective wear comprising:

a) a core having at least one strand of flexible, stainless steel wire having a diameter of about 0.002 inches and at least one strand of a polymeric fiber wherein said fiber contains an antimicrobial within a matrix of said polymer;

b) a first wrap wound in one direction about the core, said first wrap being a polyester fiber having a denier in the range of 40–600; and, c) the second wrap wound in a second direction about said core, said second wrap being least one strand of a polyester fiber having a denier in the range of 40–600.

2. The yarn of claim 1, wherein said first wrap has a denier of substantially 240.

3. The yarn of claim 2, wherein said second wrap has a denier of substantially 240.

4. The yarn of claim 1, wherein said first and second wraps are wrapped at a rate of 7–12 wraps per inch about said core.

5. The yarn of claim 1, wherein said anti-microbial treated fiber is an acetate-based fiber contain the active ingredient 5 chlor-2-(2,4 dichlorophenoxy) phenol.

6. The yarn of claim 1, wherein said anti-microbial treated fiber is an acetate-based fiber containing an agent equivalent to 5 chlor-2-(2,4 dichlorophenoxy) phenol.

7. The yarn of claim 1, wherein said core also includes at least one strand of a cut-resistant polyester fiber having a denier in the range of 200–100.

8. The yarn of claim 7, wherein said cut-resistant fiber has a denier of substantially 420.

9. The yarn of claim 1, wherein the said core also includes at least one strand of a cut-resistant fiber including long chain polyethylene, p-aramid, liquid crystalline polyester, or glass fiber or polybenzo-bisoxazole polymeric fiber having deniers in the range of 200 to 1000.

10. The yarn of claim 9, wherein said cut-resistant fiber has a denier in the range of 200 to 400.

11. A cut-resistant knittable yarn for making fabric to be used in the manufacture of protective wear comprising:

a) a core including at least two longitudinally extending synthetic fibers;

b) at least one wrap wound around said core made from a synthetic fiber; and, c) one of said fibers comprising an anti-microbial treated fiber wherein said anti-microbial treated fiber is a polymer that contains the anti-microbial within a matrix of the polymer.

12. The yarn of claim 11, wherein said anti-microbial treated fiber comprises an acetate-based fiber.

13. The yarn of claim 12, wherein said acetate-based fiber contains an anti-microbial agent forming part of a matrix of the polymer.

14. The yarn of claim 11, wherein said anti-microbial treated fiber is an arylic-based fiber.

15. The yarn of claim 14, wherein said acrylic-based fiber contains an anti-microbial agent forming part of a matrix of the polymer.

16. The yarn of clam 11, wherein said anti-microbial treated fiber is an olefinic fiber.

17. The yarn of claim 16, wherein said olefinic-based fiber containing an anti-microbial agent forming part of a matrix of the polymer.

* * * * *